United States Patent [19]

McCoy, Sr. et al.

[11] Patent Number: 4,463,949

[45] Date of Patent: Aug. 7, 1984

[54] MACHINE FOR ARM WRESTLING

[75] Inventors: George W. McCoy, Sr.; George W. McCoy, Jr., both of Olathe, Kans.

[73] Assignee: McCoy Manufacturing Company, Olathe, Kans.

[21] Appl. No.: 553,767

[22] Filed: Nov. 21, 1983

[51] Int. Cl.[3] ..... A63B 21/28

[52] U.S. Cl. ..... 273/1 GI; 272/143; 272/901

[58] Field of Search ..... 273/1 GI, 1 GC; 272/67, 272/901, 117, 118, 143, 130, 132, 134, 136

[56] References Cited

U.S. PATENT DOCUMENTS

| | | | |
|---|---|---|---|
| 2,832,334 | 4/1958 | Whitelaw | 272/132 X |
| 3,089,700 | 5/1963 | Hotas | 272/117 |
| 3,495,824 | 2/1970 | Cuinier | 272/130 |
| 3,743,284 | 7/1973 | Rhodes et al. | 273/1 GI |
| 3,953,026 | 4/1976 | Stokely | 272/901 X |
| 3,982,757 | 9/1976 | McDonnell | 272/136 X |
| 4,184,675 | 1/1980 | Rogerson | 272/901 X |
| 4,402,502 | 9/1983 | Peters | 272/143 X |
| 4,406,454 | 9/1983 | Dean | 272/130 X |
| 4,427,194 | 1/1984 | Dion | 272/901 X |

FOREIGN PATENT DOCUMENTS

| | | | |
|---|---|---|---|
| 2200542 | 7/1973 | Fed. Rep. of Germany | 273/1 GI |

*Primary Examiner*—Paul E. Shapiro

*Attorney, Agent, or Firm*—Schmidt, Johnson, Hovey & Williams

[57] ABSTRACT

An arm wrestling device operable to allow contestants to wrestle using either arm is provided, and is particularly useful in preventing one contestant from gaining a mechanical advantage over the other contestant irregardless of forearm length. An adjustable arm support pad is provided which is vertically shiftable above the support surface to allow a short-armed person to wrestle a long-armed person with each person enjoying the same initial advantage. Preferably, the arm wrestling device hereof includes a pair of elongated levers each secured to an elongated cylindrical shaft, with the shafts being rotatably mounted in generally parallel relationship to each other. The shafts are interconnected by a shiftable gearing and linkage mechanism whereby one contestant can wrestle using his right arm and the other contestant can wrestle using his left arm. That is, the device can be operated such that the levers will pivot in the same direction or alternatively, pivot in opposite directions. With the levers operably coupled to pivot in opposite directions, the device hereof allows a right-handed contestant to wrestle a left-handed contestant.

13 Claims, 17 Drawing Figures

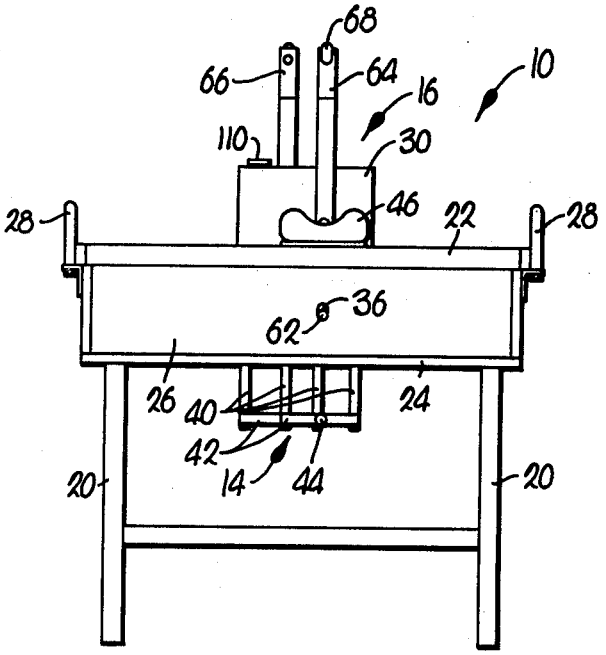
Fig. 1
Fig. 4
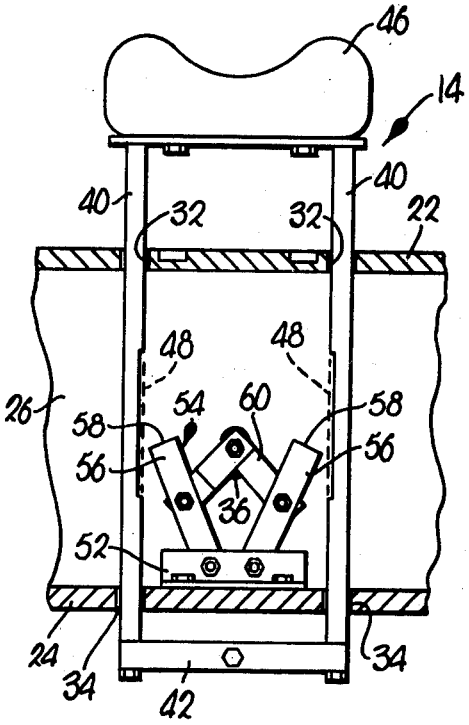
Fig. 2
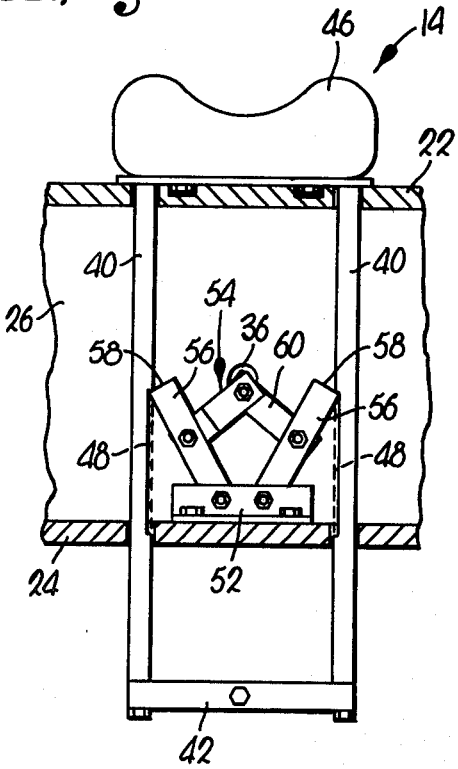
Fig. 3
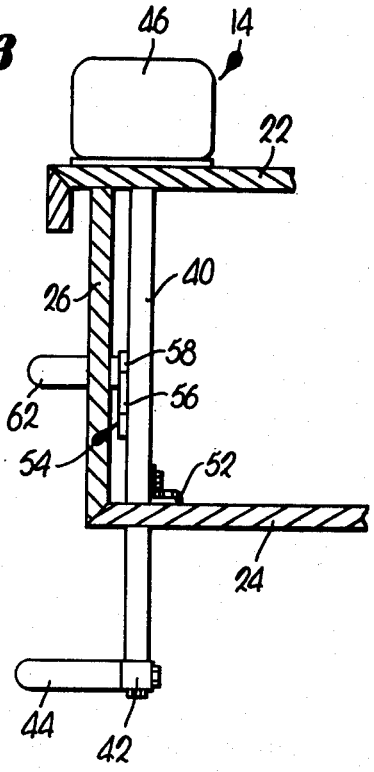

MACHINE FOR ARM WRESTLING

BACKGROUND OF THE INVENTION

1. Field of the Invention

This invention relates to a arm wrestling device which has numerous advantages including the elimination of any advantage a long-armed contestant would have over a short-armed contestant and the ability of the device to allow a right-handed contestant to wrestle a left-handed contestant. Particularly, it is concerned with an arm wrestle device having a mechanism interconnecting the two arm wrestling levers which is selectively operable to allow contestants to wrestle regardless of which arm they use.

2. Description of the Prior Art

Arm wrestling has enjoyed a long history of popularity, with conventional arm wrestling simply entailing two contestants facing each other across a table, placing elbows on the table, grasping hands, and, starting with their arms in a generally upright position, attempting to pin the other contestant's hand to the table. Although this competition is quite simple, it suffers from several deficiencies. For example, longer-armed contestants can have a slight mechanical advantage over shorter-armed contestants due to the length of their forearms. Further, it will be appreciated that conventional arm wrestling only allows persons to wrestle using the same arms. That is, both contestants must use either the right arm or the left arm. Thus, one contestant cannot use his right arm and the other contestant his left arm. Still another problem that has existed in conventional arm wrestling is that arm strength is not necessarily determinative of the outcome of the competition. That is, the fact that the contestants are in hand-to-hand engagement allows certain techniques to be used which will aid the contestant having knowledge of such techniques.

Several arm wrestling machines have been proposed in the past which overcome some of these problems associated with conventional arm wrestling, but are deficient in a number of respects. Such arm wrestling machines generally eliminate hand-to-hand contact between contestants thereby making the contest dependent upon arm strength, not technique. Although these past arm wrestling machines have been effective in eliminating hand-to-hand contact between contestants, they are deficient in that heretofore it has been impossible for one contestant to wrestle using his right arm and the other contestant to wrestle using his left arm. Further, many such machines have not been adjustable to account for different arm lengths of the contestants. Those machines that have included adjustable features have not done so in a way to properly support the contestant's arm or to eliminate a mechanical advantage enjoyed by one of the contestants. Thus, it would be highly desirable if a arm wrestling device were devised which was selectively operable to allow contestants to use either arm to wrestle, and was able to accommodate different arm sizes without giving either contestant a starting advantage.

SUMMARY OF THE INVENTION

The problems outlined above are in large measure solved by the arm wrestling device in accordance with the present invention. That is, the arm wrestling device hereof not only eliminates hand-to-hand engagement between the contestants, but additionally allows contestants to wrestle using which ever arm they choose. In preferred forms, the arm wrestling device hereof incorporates an adjustable arm support pad which allows contestants having different arm sizes to wrestle without either contestant enjoying an initial advantage.

The arm wrestling device in accordance with the present invention broadly includes a generally flat support surface, a pair of elongated spacedapart levers, and means mounting each lever for pivoting about a point adjacent the support, with each lever pivoting in a plane generally transverse to the support surface. Advantageously, the device includes means operably coupling the levers with structure permitting selective operation of the arm wrestling device in either of two operating modes. In the first mode, the levers are operably interconnected to pivot in the same direction, thereby allowing contestants to arm wrestle with each contestant using the same arm to grasp the respective lever. In the second operating mode, the levers are operably interconnected to pivot in opposite directions, thereby allowing contestants to arm wrestle with one contestant using the right arm, while the other contestant uses the left arm. Preferably, the levers are respectively mounted to a pair of rotatably mounted parallel shafts. Advantageously, each shaft has two gears mounted thereon and structure is provided to interconnect the gears of one shaft to the gears of the other shaft depending on the operating mode of the arm wrestling device desired.

In particularly preferred forms, one of the lever shafts has first and second gears fixedly mounted thereon, while the other shaft has a first gear fixedly mounted and a second gear which is rotatably secured, but longitudinally shiftable. Preferably, a shiftable idler gear is provided which is selectively positionable to operably interconnect the first gears of the respective shafts. Alternatively, with the idler gear disengaged, the shiftable second gear of the other shaft can be positioned in operable mesh with the second gear of the first shaft to provide an alternative operating mode. Advantageously, an adjustable arm support is provided adjacent each lever, with the support being vertically adjustable to accommodate different arm lengths between contestants.

In preferred forms, the adjustable arm support device of the present invention presents a pair of generally parallel rods, an elongated pad transversely secured the uppermost end of each rod, and means for vertically positioning the rods. Each rod includes a plurality of notches on the inboard surface of the rod, with the vertical positioning means disposed between the rods and below the pad. Advantageously, the positioning means includes a pair of generally upright stop structures with each stop being pivotal between a notch-engaging position and a disengaged position. Further, the positioning means includes means for shifting the stop structures from the notch-engaging position to the disengage position, whereby the rods may be selectively vertically supported depending upon the position selected for the stop structures.

BRIEF DESCRIPTION OF THE DRAWINGS

FIG. 1 is an elevational view of the arm wrestling device in accordance with the present invention;

FIG. 2 is fragmentary sectional view and illustrates the front elevation of the adjustable arm support in accordance with the present invention, with the stop structure shown in the notch-engaging position;

FIG. 3 is a fragmentary sectional view depicting the side elevation of the adjustable arm support hereof;

FIG. 4 is a fragmentary sectional view showing the front elevation of the adjustable arm support hereof, with the stop structures shown in the disengage position;

DESCRIPTION OF THE PREFERRED EMBODIMENT

Figure 5:
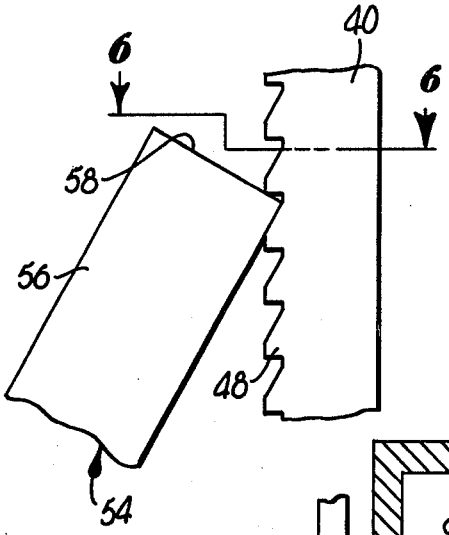
FIG. 5 is an enlarged fragmentary elevational view showing the engagement of a stop structure with the notches of a rod of the adjustable arm support.
Figure 6:
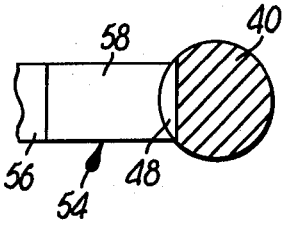
FIG. 6 is a sectional view taken along line 6—6 of FIG. 5.

Referring now to the drawing, the preferred embodiment of the arm wrestling machine 10 in accordance with the present invention is illustrated in FIGS. 1–14, and broadly includes a support table 12, a pair of adjustable arm supports 14, and an operating mechanism 16 supported in a central location on the table 12 between the two arm supports 14 (see FIG. 1). Preferably, the support table 12 is configured to present four support legs 20, a generally planar rectangularly shaped table top 22, a generally planar rectangularly shaped bottom covering 24 spaced from and parallel to the table top 22, and four rectangularly shaped sidewalls 26 circumferentially spaced around the support table 12 to interconnect the bottom covering 24 and table top 22. Advantageously, a pair of elongated, cylindrically shaped hand grips 28 are mounted at each end of the table 12. Further, the support table 12 includes a rectangularly shaped, box-like covering 30 overlying the operating mechanism 16. As seen in FIGS. 1–4, table top 22 includes a pair of spaced-apart apertures 32 adjacent each lateral side margin of the top 22 for mounting the respective arm support 14. Complementally, the bottom covering 24 presents a pair of spaced-apart apertures 34 adjacent each lateral side margin thereof, with the apertures 32, 34 aligned as shown in FIGS. 2, 4. Additionally, the two longitudinally oriented sidewalls 26 include an elongated slot 36 located approximately between the respective apertures 32, 34.

Turning now to the adjustable arm supports 14, it will be appreciated that each arm support is identical, therefore only one arm support 14 will be described herein. Preferably, the arm support 14 presents a pair of elongated, spaced-apart, generally parallel cylindrically-shaped rods 40, with each rod 40 received through the respective aligned apertures 32, 34 (see FIGS. 2, 4). Rods 40 are fixedly interconnected at their lowermost ends by elongated bar 42 (using conventional machine screws, or the like). As illustrated in FIGS. 2, 4, bar 42 interconnects the respective rods 40 beneath the bottom covering 24, and as shown in FIG. 3, an elongated cylindrically-shaped adjustment handle 44 is centrally affixed to the bar 42. Rods 40 are fixedly interconnected at their uppermost margins above the table top 22 by an elongated elbow pad 46. Advantageously, the rods 40 are thus fixedly interconnected to present a rectangularly-shaped structure, with each rod 40 presenting a plurality of downwardly oriented notched 48 along the inboard surface of each rod 40 (see FIG. 5).

The adjustable arm support 14 further includes vertical positioning means 50 located generally between the table top 22 and bottom covering 24, and between the respective rods 40. To this end, the positioning means 50 includes an angle iron support bracket 52 mounted to the uppermost face of the bottom covering 24 (as by woodscrews, see FIGS. 2–4). A pair of generally upright stop structures 54 are pivotally coupled to the bracket 52 and preferably comprise an elongated flattened bar 56 having a lowermost end pivotally mounted (as by machine screw) to the bracket 52 and an uppermost end defining a flattened notch-engaging surface 58. A pair of links 60 are pivotally interconnected to each other at one end thereof, with the other end of each link being pivotally coupled to a respective bar 56 at a medial location on the bar 56. An elongated, cylindrically-shaped handle 62 is secured to the link 60 at the pivotal interconnection therebetween, and extends transversely relative links 60 (see FIG. 3). Advantageously, the handle 62 is shiftable and extends outwardly through the slot 36 of the respective sidewall 26.

Turning now to the operating mechanism 16 of the machine 10, it will be appreciated viewing FIGS. 7–14 that the mechanism 16 includes structure for operating between first and second modes. In more detail, the operating mechanism 16 includes a pair of elongated, spaced-apart levers 64, 66, with each lever presenting a transversely mounted handle 68 affixed to the uppermost end thereof (FIG. 1). Each lever 64, 66 is transversely secured to an elongated cylindrical shaft 70, 72 respectively, at the lowermost end thereof, with the shafts oriented generally parallel and spaced apart from each other. It will be appreciated, that each shaft 70, 72 is mounted to the table top 22 by a plurality of conventional pillow blocks, thus rotation of the respective shafts 70, 72 pivots the respective levers 64, 66 in a plane generally transverse to the table top 22. Further, a pair of rectangularly-shaped mounting brackets 74 are secured in generally transverse orientation to the table top 22, with the shaft 70, 72 located within the rectangular cross section of the brackets 74 (see FIGS. 7, 9).

Figure 8:
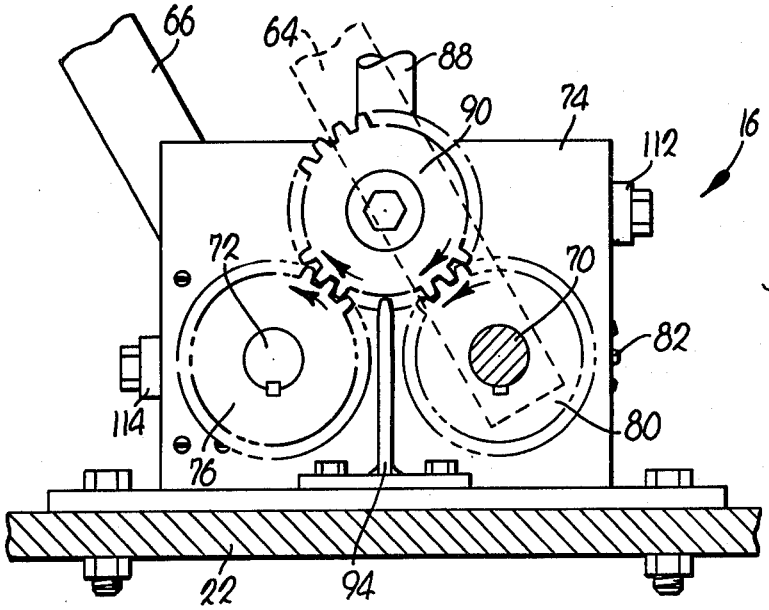
FIG. 8 is a front elevational view of the operating mechanism of the device hereof illustrating the operable mesh of the idler gear to the respective shaft gears, and illustrates in phantom one of the levers moving in the same direction with the other lever.
Figure 10:
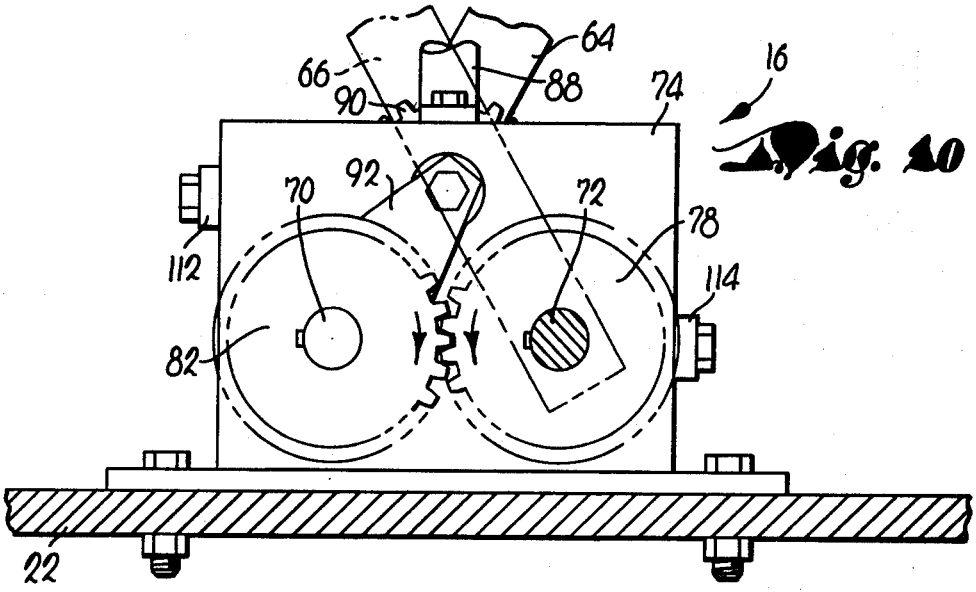
FIG. 10 is a back elevational view depicting the operable mesh of the second gears of the operating mechanism and depicts in phantom one of the levers moving in a direction opposite to the direction of movement of the other lever.
Figure 9:
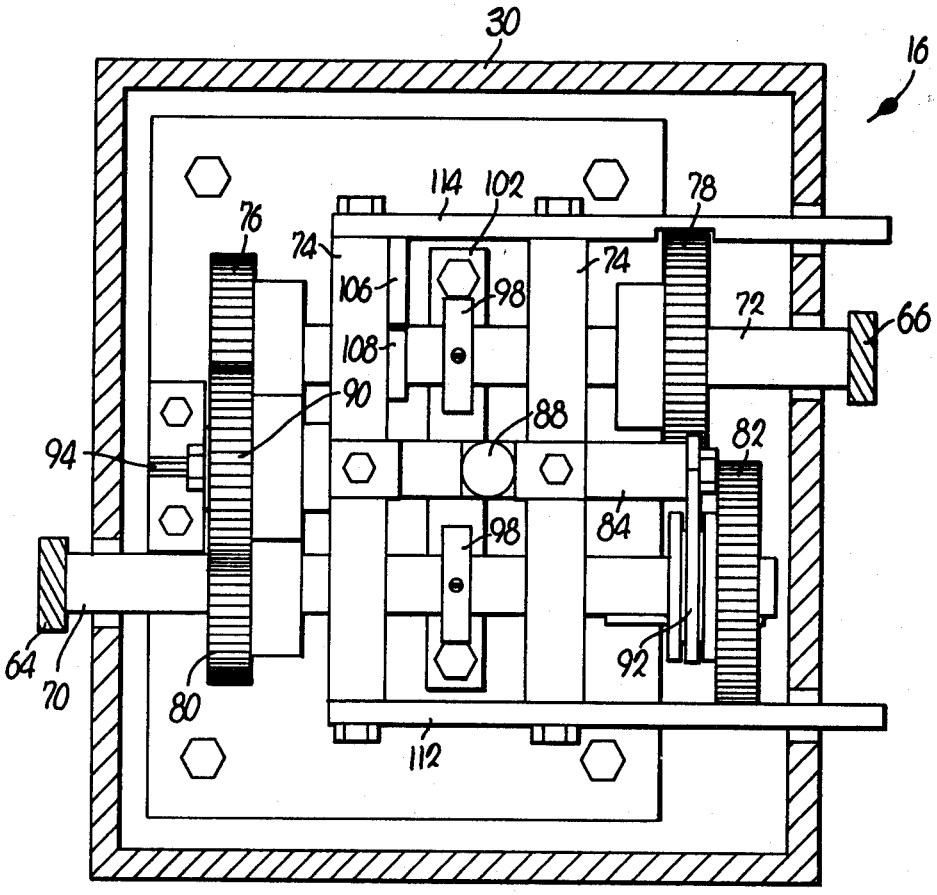
FIG. 9 is a top plan view of the operating mechanism of the device hereof with parts sectionalized for clarity, and illustrates the device when in the first operating mode.
Figure 11:
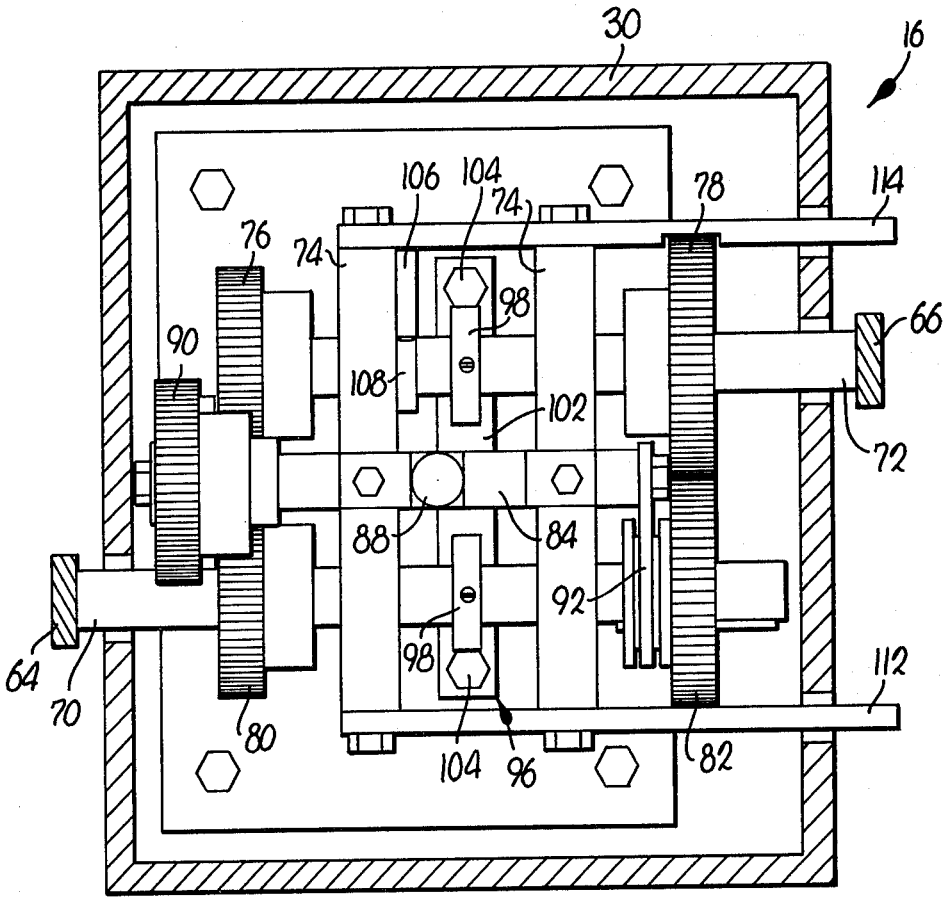
FIG. 11 is a top plan view with parts sectionalized for clarity, and is similar to FIG. 9 but illustrates the operation of the device when in the second operating mode.

Turning now to FIGS. 9, 11, it will be seen that shaft 72 presents a first gear 76 fixedly mounted adjacent the end opposite the lever 66, and a second gear 78 fixedly mounted to the shaft 72 near the lever 66. Advantageously, the shaft 70 includes a first gear 80 fixedly mounted adjacent the lever 64 and a second gear 82 mounted at the other end of the shaft 70, with the second gear 82 rotatably secured by a cotter key but longitudinally shiftable on the shaft 70. It is readily apparent viewing FIGS. 8–11, that respective first gears 76, 80 are fixedly secured about their respective shafts in a co-planar arrangement, but are of a smaller diameter such that the teeth of the gears 76, 80 are not in direct operable mesh. Conversely, the second gears 78, 82 are of a slightly larger diameter, such that the gear 82 can be shifted into operable mesh with the gear 78, or shifted out of operable mesh (compare FIGS. 9 and 11).

A third shaft 84 is rotatably mounted to the respective brackets 74 (as by pillow blocks) above and between the shafts 70, 72. An elongated cylindrical upright handle 88 is tranversely secured to the shaft 84 between the respective mounting brackets 74, and advantageously, the shaft 84 is longitudinally shiftable. One end of the shaft 84 has an idler gear 90 mounted thereon, while the other end of the shaft 84 has a shifting arm 92 secured thereto. It will be apparent viewing FIGS. 7, 9–11, that the shifting arm 92 is secured to the shaft 84 at one end, while the other end of shifting arm 92 is operably connected to the second gear 82 by way of a fork and groove linkage. Furgear 90 into mesh with gears 76, 80.

The operating mechanism 16 further includes a centering device 96 which advantageously operates to bias the respective levers 64, 66 into a generally vertical upright orientation for starting the contest (see FIGS. 9–12). In more detail, the centering device 96 includes a pair of cams 98 fixedly mounted to the respective shaft 70, 72 in a generally coplanar relationship to each other. Cams 98 are preferably circular in cross-section with a small flat 100 extending along a chord line of the circular cross section of each cam 98. Beneath each cam 98 is mounted an elongated flat plate 102, with each distal end of the plate 102 apertured for the sliding reception of a mounting bolt 104 coupling the plate 102 to the table top 22. Viewing FIG. 12, it will be seen that a coil spring is received about the respective mounting bolt 104 beneath the plate 102, upwardly biasing the plate 102 toward the respective cams 98.

Figure 13:
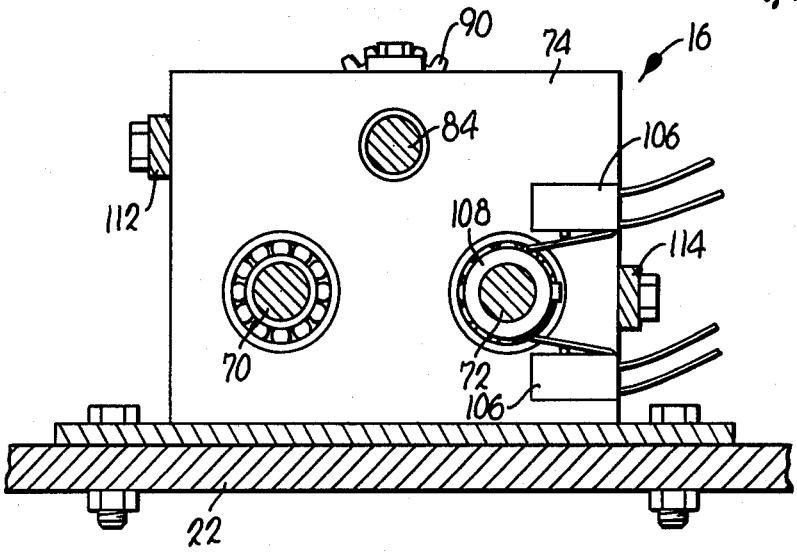
FIG. 13 is a vertical sectional view of the device hereof and particularly illustrates signaling apparatus for determining when one lever has been pivoted a predetermined amount.
Figure 14:
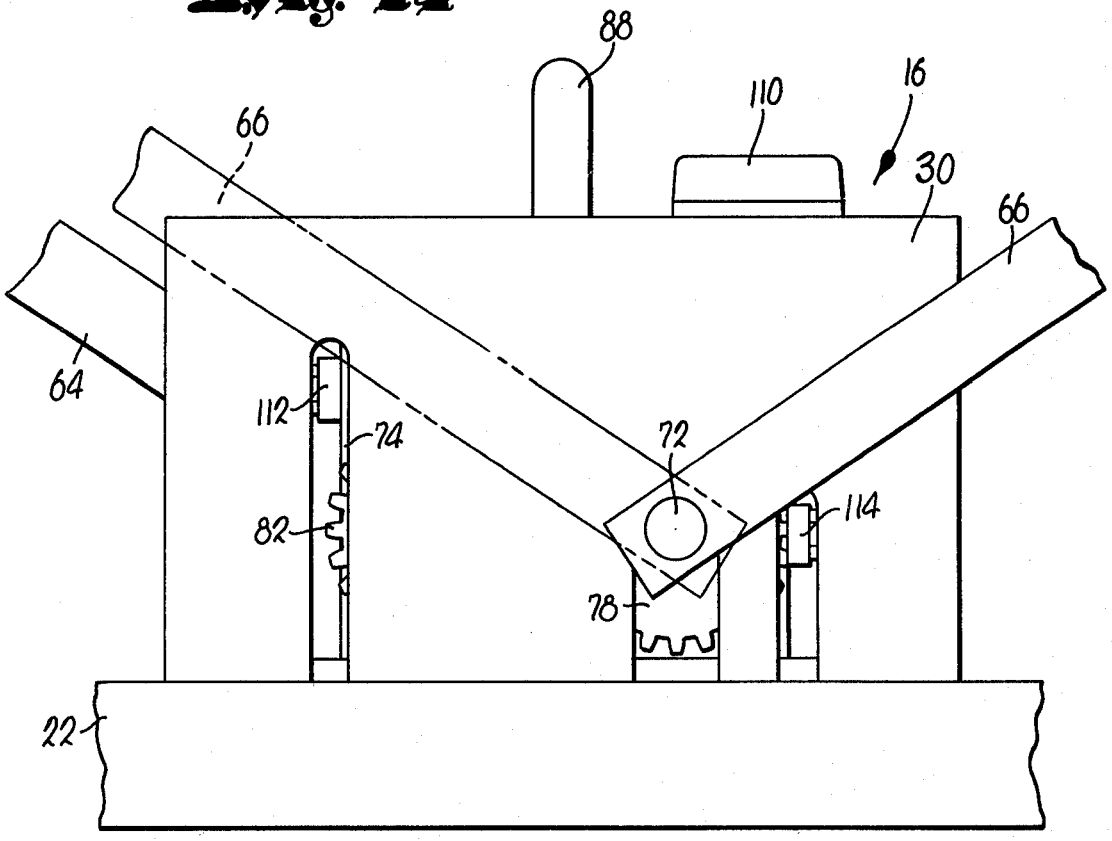
FIG. 14 is a fragmentary elevational view of the device hereof and depicts the total pivotal amount of travel of one of the levers hereof.

In the preferred embodiment, the operating mechanism 16 includes a signaling device which will reliably indicate when the arm wrestling contest has been concluded. Thus, viewing FIG. 13, a pair of microswitches 106 are operatively mounted to one of the brackets 74 on either side of the shaft 72. Shaft 72 includes a trip mechanism 108 secured thereto, it being appreciated that the trip mechanism 108 is equidistant from the respective microswitches 106 when the respective levers 64, 66 are positioned in their upright, starting position. Advantageously, the microswitches 106 are electrically connected to a signal lamp 110 which illuminates when one of the microswitches 106 is actuated by the trip mechanism 108 (see FIG. 14). Further illustrated in FIGS. 13, 14 are a pair of limiting devices 112, 114 which limit the amount of pivotal travel of the lever 66. Each limiting device 112, 114 presents an elongated flattened bar respectively secured to the mounting brackets 74. That is, the limiting device 112 is transversely secured to the mounting brackets 74 adjacent the uppermost end thereof and extends outwardly towards the lever 66 and beyond the pivotal plane of lever 66. The limiting device 114 is transversely secured to the mounting brackets 74 on the opposite side of the brackets 74 at a more central location and similarly extends beyond the pivotal plane of lever 66 (see FIG. 14). It will be appreciated that the limiting device 112 is mounted higher relative the limiting device 114 in order that the amount of pivotal travel of the lever 66 be the same in both directions. Thus, viewing FIG. 14, the lever 66 is mounted closer to the limiting device 114 and, therefore, the devices 112, 114 are mounted to stop the pivotal travel of the lever 66 at the same angular relationship in either direction.

In operation, the arm wrestling machine 10 of the present invention is uniquely adaptable to a particular contestant and allows each contestant to wrestle without either contestant enjoying an initial advantage. Thus, the contestant may use either arm to wrestle, and does so by placing the elbow of the selected arm in the pad 46, grasping the handle 68 with the hand of the selected arm, and with the free hand grasps hand grip 28 and begins wrestling. Viewing FIGS. 1–6, it is readily apparent that the arms supports 14 are easily vertically adjustable to accommodate the contestant regardless of his forearm length. It should be noted in this regard that the distance from the rotation point of the levers 64, 66 to their respective handles 68 remains constant, thus, the mechanical advantage through the operating mechanism 16 remains constant.

To adjust the arm support 14 upwardly, the contestant simply has to grasp handle 44 and/or the elbow pad 46, and move the rods 40 upwardly. That is, with the vertical positioning means 50 disposed in the notch-engaging position shown in FIG. 2, the orientation of the notches 48 relative the notch-engaging surface 58 (see FIG. 5) allows the arm support 14 to be upwardly moved without restriction. It will be appreciated that the vertical positioning means 50 is placed in the notch-engaging position by pushing the handle 62 downwardly in the slot 36, which in turn forces the links outwardly, outwardly diverging the bars 56. As shown in FIG. 4, the vertical positioning means 50 is easily placed in the disengage position by raising upwardly the handle 62 in the slot 36 with the action of the links 60 drawing the bars 56 convergingly inward, which of course disengages the notch-engaging surfaces 58 from the notches 48. It will be appreciated that in the disengage position, the arm support 14 can be raised or lowered as desired.

Turning now to FIGS. 7–14, the operation of the mechanism 16 is illustrated. That is, the operating mechanism 16 is selectively operable in either a first or second operating mode. In the first operating mode, the levers 64, 66 are operably interconnected to pivot in the same direction to allow the contestants to arm wrestle using the same arm. That is, each contestant can wrestle using the right arm respectively, or each contestant can use the left arm. In the second operating mode, the levers are operably interconnected to pivot in opposite directions, allowing contestants to arm wrestle with one contestant using the right arm and the other contestant using the left arm. It will be seen that the selection between the first and second operating modes is made by simply moving the handle 88 to longitudinally reposition shaft 84.

Figure 7:
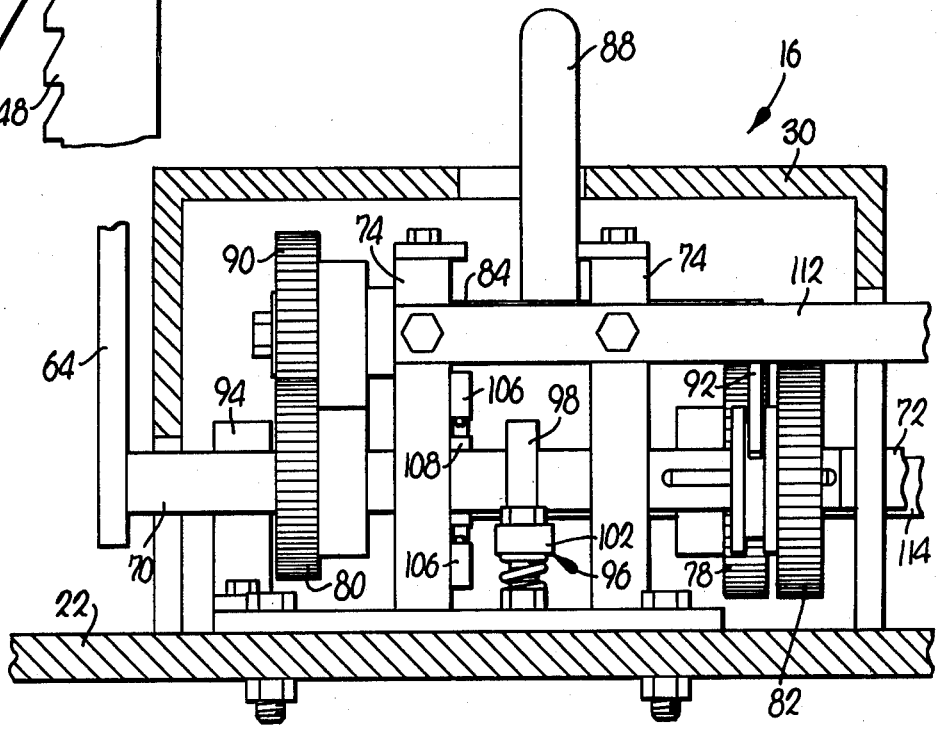
FIG. 7 is a fragmentary side elevational view of the arm wrestling device of the present invention, with the casing and support surface sectionalized for clarity.

Viewing FIGS. 7–9, the operating mechanism 16 is illustrated in the first mode, with the lever 64, 66 pivoting in the same direction. Mechanism 16 is placed in the first mode by shifting the handle 88 toward lever 66, which in turn longitudinally shifts the shaft 84. Shifting the shaft 84 brings the idler gear 90 into operable mesh with the respective first gears 76, 80 (see FIG. 8). Concurrently with bringing the idler gear 90 into operable mesh with the gears 76, 80, movement of the shaft 84 causes the shifting arm 92 to disengage the shiftable second gear 82 from the second gear 78. That is, in the first operating mode the transmission power line between the shafts 70, 72 is through the gears 76, 90, 80. As seen in FIG. 8, in the first operating mode, the levers 64, 66 pivot in the same direction to allow the contestants to wrestle using the same arm.

Turning to FIGS. 10–11, the second operating mode of the mechanism 16 is depicted. In the second mode, the handle 88 is shifted toward the lever 64, thus repositioning the shaft 84 in the direction of the lever 64. With the shaft 84 shifted toward the lever 64, the idler gear 90 is taken out of operable mesh between the first gears 76, 80 while the shiftable second gear 82 is placed in operable mesh with the second gear 78 by the shifting arm 92. As seen in FIG. 10, in the second operating mode, the levers 64, 66 pivot in opposite directions, thereby allowing a right handed contestant to wrestle a left handed contestant. It will be appreciated that the limiting devices 112, 114 simply stop the lever 66 from pivoting all the way to the table top 22. Of course, because the levers 66, 64 are always operably interconnected, lever 64 is likewise not allowed to pivot all the way to the table top 22. This limiting of the pivotal travel of the levers 64, 66 is simply to prevent injury to the contestants that might result from slamming the hand to the table between the handle 68 and the table top 22.

Figure 12:
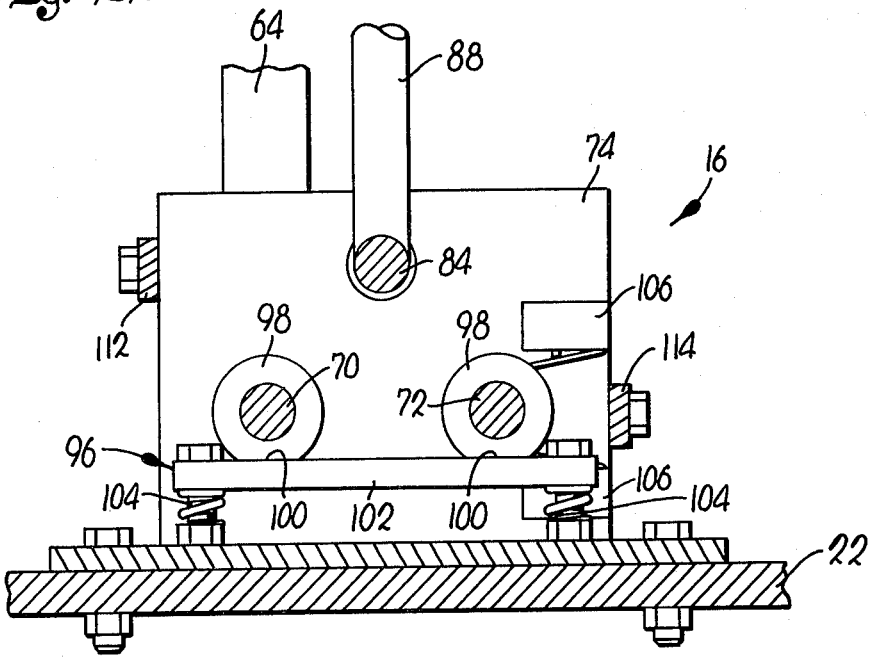
FIG. 12 is a vertical sectional view and shows the camming arrangement which biases the respective levers into a generally upright, starting position.

Turning to FIG. 12, it is seen that the centering device 96 is advantageous in positioning the levers 64, 66 into the starting, straight-up, neutral position. Thus, the cams 98 will turn with the respective shafts 70, 72 during the wrestling match by downwardly compressing the plate 102. However, with the levers 64, 66 returned to the upright position, the respective flats 100 tend to retain the levers in the starting position because of the engagement of flats 100 with the plate 102.

Figure 15:
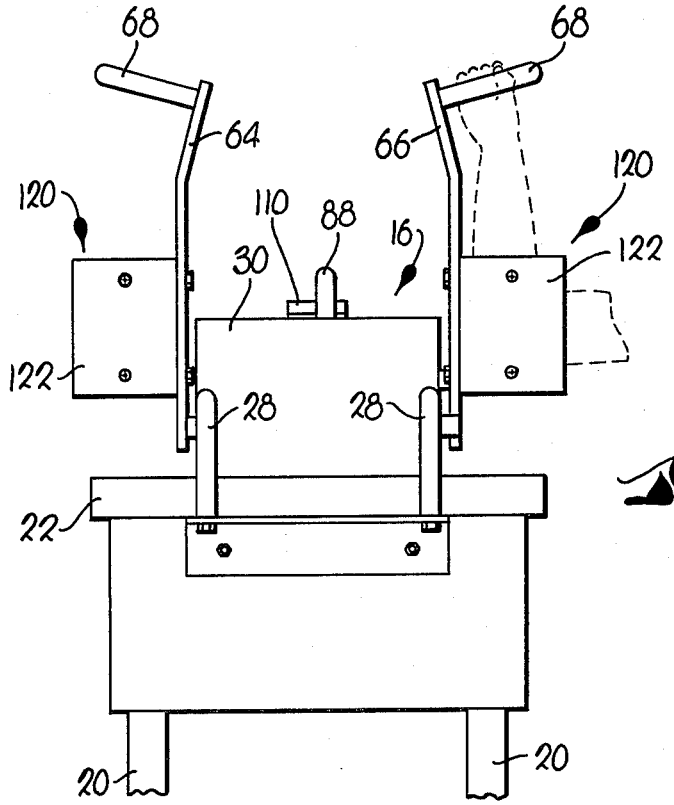
FIG. 15 is a fragmentary, elevational view of an alternative embodiment of the invention hereof.
Figure 17:
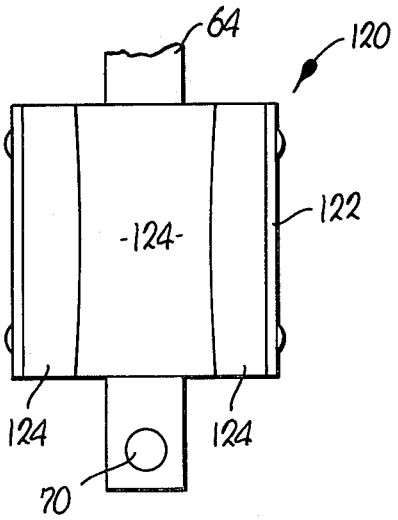
FIG. 17 is a fragmentary elevational view of the arm support clevis of the alternative embodiment of the invention hereof.
Figure 16:
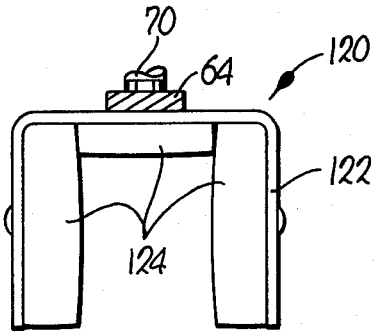
FIG. 16 is a fragmentary plan view of the arm support clevis of the alternative embodiment.

In FIGS. 15–17, an alternative embodiment of the present invention is illustrated. The primary difference between the alternative embodiment illustrated in FIGS. 15–17 and the preferred embodiment is the absence of the adjustable arm support structure 14 from the alternative embodiment. Instead, the alternative embodiment incorporates an arm support clevis 120 as shown in FIGS. 15–17. Because of the similarities, the reference numerals applied to the preferred embodiment have been retained for use in FIGS. 15–17, where applicable.

Each arm support clevis 120 present a U-shaped in cross-section, elongated bracket 122, with the bight portion of the bracket 122 connected to a respective lever 64, 66 (as by bolts). The bracket 122 is longitudinally aligned with the respective lever 64, 66 and outwardly oriented therefrom. Advantageously, the interior walls of the bracket 122 have affixed thereto resilient pads 124 (as by bolts, washers and glue) as shown in FIGS. 16 and 17.

In use, the operation of the alternative embodiment illustrated in FIGS. 15–17 is quite similar to the operation of the arm wrestling machine 10 of the preferred embodiment. The primary difference between the operation of the two embodiments is that in the alternative embodiment, the wrestling combatant simply slides his elbow and lower forearm into the arm support clevis 120 and grasps the handle 68 of the respective lever 64, 66 (an arm is shown in phantom in FIG. 15). It will be noted that the combatant can use either arm for wrestling as in the preferred embodiment. However, in the preferred embodiment, adjustment is necessary of the arm support 14 to accommodate various forearm lengths. In the alternative embodiment, no adjustment is necessary as the elongated arm support clevis 120 is of a sufficient dimension to accommodate almost any forearm length.

It should be readily apparent from the above description of the present invention that the arm wrestling machine hereof has numerous advantages including the capability to allow one contestant to wrestle using his right arm and the other contestant to wrestle using his left arm. Further, the arm wrestling machine 10 allows contestants to wrestle without either contestant enjoying an initial advantage because of forearm length. That is, the preferred embodiment includes an adjustable arm support 14, while the alternative embodiment incorporates an arm support clevis 120, both of which allow contestants with different forearm lengths to arm wrestle without an undue leverage advantage. Those skilled in the art will appreciate that many alternative embodiments of the present invention are possible without departing from the spirit and scope of the present invention.

I claim:

1. An arm wrestling device comprising:

a generally flat support surface;

a pair of elongated, spaced-apart levers;

means mounting each lever for pivoting about a point adjacent said support surface whereby each lever is pivotal in a plane generally transversely-oriented to said support surface; and means operably coupling said levers for allowing two contestants to arm wrestle by applying force to the respective levers, said coupling means including structure permitting selective operation between first and second operating modes, whereby in said first mode said levers are operably interconnected to pivot in the same direction allowing contestants to arm wrestle with each contestant using the same arm to grasp said lever, and in said second mode said levers are operably interconnected to pivot in opposite directions allowing contestants to arm wrestle with one contestant using the right arm and the other contestant using the left arm.

2. An arm wrestling device as claimed in claim 1, said device including a pair of elongated, generally parallel shafts rotatably mounted on said support surface with each shaft having one end affixed to a respective lever whereby pivoting of said lever rotates the respective shaft.

3. An arm wrestling device as claimed in claim 2, one of said shafts presenting first and second spaced apart gears fixedly secured thereto, and said other shaft presenting a first gear fixedly secured thereto and a second gear rotatably secured and longitudinally shiftable relative said other shaft.

4. An arm wrestling device as claimed in claim 3, said first gears of said respective shafts being generally coplanar and spaced-apart, out of mesh with each other.

5. An arm wrestling device as claimed in claim 4, said device including an idler gear operably shiftable between a first position in which said idler gear is in operable mesh with both of said first gears thereby interconnecting said first gears, and a second position in which said idler gear is not in operable mesh with both of said first gears.

6. An arm wrestling device as claimed in claim 3, including structure for selectively shifting said second gear of said other shaft between an engaging position in which said second gears are in operable mesh and a disengage position in which said second gears are not in operable mesh.

7. An arm wrestling device as claimed in claim 2, one of said shafts including a trip mechanism for actuating a signaling device when said one shaft is rotated beyond a predetermined amount.

8. An arm wrestling device as claimed in claim 2, each shaft including a cam and said device includes an upwardly-biased cam-engaging plate which allows each shaft to rotate and biases each cam to a predetermined position relative to said plate.

9. An arm wrestling device as claimed in claim 1, said device including structure for limiting the amount of pivotal movement of one of said levers.

10. An arm wrestling device as claimed in claim 1, including means for signaling when one of said lever has been pivoted a predetermined amount.

11. An arm wrestling device as claimed in claim 1, including a pad mounted to said support surface adjacent each of said levers, each pad being vertically adjustable relative said support surface.

12. An arm wrestling device as claimed in claim 1, including an elongated, U-shaped clevis secured to each of said levers for receiving a portion of the arm of an arm wrestling combatant.

13. An arm wrestling device as claimed in claim 1, including means for biasing each lever into a generally upright orientation relative said support surface.

* * * * *